United States Patent [19]

Chimento

[11] Patent Number: 4,979,276

[45] Date of Patent: Dec. 25, 1990

[54] METHOD OF MANUFACTURING ARTICLES SUITABLY USED AS NECKLACES, BRACELETS AND SIMILAR ITEMS

[75] Inventor: Adriano Chimento, Vicenza, Italy

[73] Assignee: Chimento S.P.A., Vicenza, Italy

[21] Appl. No.: 446,599

[22] Filed: Dec. 6, 1989

[30] Foreign Application Priority Data

Feb. 6, 1989 [IT] Italy ..... 85519 A/89

[51] Int. Cl.[5] ..... B21F 43/00

[52] U.S. Cl. ..... 29/160.6; 63/5.1; 63/5.2; 59/79.2; 59/35.1; 29/433

[58] Field of Search ..... 29/160.6, 433; 63/2, 63/5.1, 5.2, 11; 59/35.1, 79.1, 79.2

[56] References Cited

U.S. PATENT DOCUMENTS 326,606 9/1985 Tingley ..... 63/11

331,033 11/1885 Chadwick ..... 63/5.1

1,147,467 7/1915 Varga ..... 63/5.1

*Primary Examiner*—P. W. Echols

*Attorney, Agent, or Firm*—Birch, Stewart, Kolasch & Birch

[57] ABSTRACT

A method of manufacturing articles suitable as necklaces or bracelets, which consists of inserting on a core material which is provided in the form of a substantially cylindrically shaped helicoidal spring made of a spirally wound metal wire or a strap having a constant cross-section, a plurality of elements each consisting of a body member associated with one or more grommets or slots creating one or more closed apertures free end of the helicoidal spring is introduced through the annular spaces of a succession of elements and by causing the elements to slide toward the opposite end of the spring, so that they arrange themselves one next to the other.

5 Claims, 1 Drawing Sheet

METHOD OF MANUFACTURING ARTICLES SUITABLY USED AS NECKLACES, BRACELETS AND SIMILAR ITEMS

BACKGROUND OF THE INVENTION

The invention concerns a method of manufacturins articles such as necklaces, bracelets and similar items, especially those made of gold or other precious metals, which acquire a generally tube-shaped form.

In the field of custom jewelry or of jewelry production the composition of necklaces, bracelets or similar items is usually obtained by linking together a number of elements, either simple or complex, which are connected with other equal elements either directly or by means of connecting organs.

The manufacture of the complex elements and the various junction elements suited to link the former together in order to obtain the necklace and the bracelet requires the use of pivots or grommets and, at any rate, of welding processes in order to fix the pivots on the corresponding elements or to close connecting grommets, so as to obtain reliably put together necklaces and bracelets.

The above-mentioned working methods require a considerable expense in labor, remarkable skill and a special care in the welding of one element to the other, so that the manufactured object may present the most pleasing aspect from an aesthetic point of view, i.e. without imperfections.

The main inconveniences arising from the described working method involve a large number of successive operations and, therefore, high labor costs. Moreover the labor involved must be highly skilled, in order to obtain a good quality.

SUMMARY OF THE INVENTION

The purpose of the present invention is that of providing an alternative method suited to manufacture necklaces, bracelets and other similar ornamental objects, overcoming the above-mentioned inconveniences.

The method of the present invention proposes to permit the manufacture of ornamental objects by decreasing the number of operations necessary to obtain the final manufactured item and by employing non-skilled labor for the assembly of the products. It also proposes to avoid a large number of welding operations while the necklaces and bracelets are being assembled and shaped.

Another purpose is to obtain objects with a different aesthetic shape from the starting basic elements.

All of the above-mentioned purposes and other will become apparent hereafter by means of a method of of manufacturing articles, especially those made of precious metals, suited to produce ornamental objects having a tube-shaped form. The manufactured article comprises an essentially elastic core consisting of a metal wire or strap with a constant cross-section, wound in a preferably cylindrical spiral, and a plurality of elements, each of which comprises a visible body surface associated with one or more slots or grommets, which are present on the body parts and will not be visible once the assembly has been completed. The method of the present invention is characterized in that each element forming the body member is inserted on a free end of the helicoidal spring through one or more of the grommets or slots, and each body member slides toward the opposite free-end of the spring until it positions itself next to the element which has previously been inserted such that each element crosses at least two turns of the spring.

Advantageously, according to the invention, necklaces, bracelets and similar ornamental objects are made from a manufactured article having an essentially helicoidal inner core on which are inserted, one after the other, equal elements having the above-described characteristics.

In order to obtain a necklace or a bracelet presenting an aesthetically pleasing effect, it is necessary for each element to be shaped such that it can be placed next to its neighboring element, so that there is no space between two adjoining elements. Since each element presents on its back surface a closed grommet or slot, it is easily understood that a succession of elements can be inserted between the turns of the spring constituting the central core and a plurality of these can cover the entire cylindrical space around the spring so as to form a tube having a uniform outer surface.

A feature which will be better described hereafter consists in the fact that the mechanical characteristics of the manufactured article depend on the amplitude of the grommet or slot, which are present on each element, in relation to the pitch of the turn of the spring constituting the inner core. In fact, if the amplitude of the grommet or of the slot of each element is larger than the pitch of the spring, it can be understood that the finished manufactured article can be stretched until two turns of the spring arrange themselves at the two ends of the opening of each element. On the other hand, if the amplitude of the grommet or slot of each element is equal to or smaller than the pitch of the turn of the inner spring of the core, the manufactured article becomes rigid and can not be extended, since the turns of the spring already lie at the ends of the opening.

The manufacturing of the article is made much easier, since it is only necessary to thread the grommet or slot of each element onto two or more turns of the helicoidal spring. This is done with each element in succession until the entire outer cylindrical surface is covered with the elements through which the spring has been threaded.

It will also be pointed out that each element constituting the manufactured article can be threaded with two or more turns of the spring, for instance three or four, provided, of course, that the amplitude of the grommet or slot is sufficient to include such a number of turns. Obviously all the elements used for that particular necklace must include the same size of grommets or slot.

BRIEF DESCRIPTION OF DRAWINGS

Further scope of applicability of the present invention will become apparent from the detailed description given hereinafter. However, it should be understood that the detailed description and specific examples, while indicating a preferred embodiment of the invention, are given by way of illustration only, since various changes and modifications within the spirit and scope of the invention will become apparent to those skilled in the art from this detailed description, and from the drawings, wherein:

With reference to FIG. 1 it can be observed that the spring 1 is a helicoidal spring obtained from a strap 2 having a constant cross-section and wound into a cylindrical spiral at a pitch which is also constant. The elements 3 are inserted on the spring 2 represented in FIG. 2. Each of the elements 3 presents a body member 4 having a visible surface and on an opposite side a grommet 5 consisting of a wire welded to the ends of element 3. Thus an aperture 6 is obtained through which two turns of strap 2 can pass.

Figure 2:
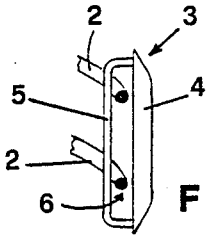
FIG. 2 shows the insertion of the grommet of an element between two turns of the spring.

Since, as can be observed in FIG. 2, the amplitude of the aperture 6 is larger than the distance between the two subsequent turns 2, it is easy to understood how the insertion of a plurality of elements 3 occurs in such a way that the elements arrange themselves next to each other, thereby covering the cylindrical space created by the helicoidal spring.

Figure 1:
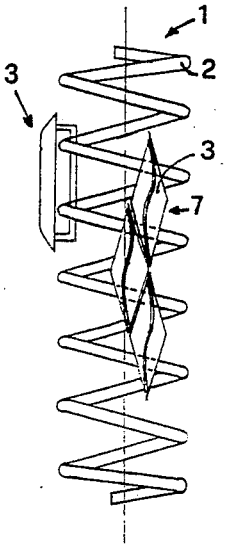
FIG. 1 shows the manufacturing of the article according to the invention during the assembly stage.
Figure 5:
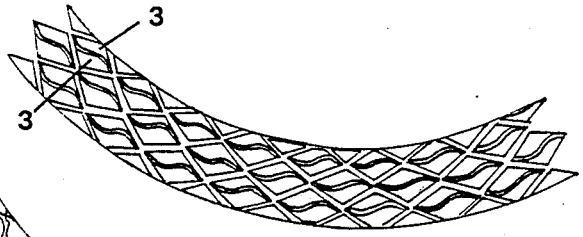
FIGS. 5, 6 and 7 show different configurations suited to create necklaces or bracelets made with different elements, but with the same method according to the invention.

Still in FIG. 1 it can be observed that two joint elements 3 form a complex element 7 of a rhomboidal type, so that the overall aesthetic effect of the manufactured article corresponds to the representation of FIG. 5, once it has been completed.

Figure 3:
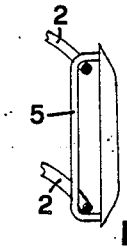
FIG. 3 shows the element of FIG. 2 when the spring is extended.

It can also be observed that since, as can be seen in FIG. 2, the aperture 6 is larger than the distance between the two turns of spring 1, when the manufactured article has been completed, it can be stretched longitudinally until the two turns rest against the ends of the grommet 5, as can be observed in FIG. 3. Thus, a necklace or a bracelet has been obtained which can be stretched to a certain degree and, consequently can offer both from an aesthetic and a functional point of view a higher degree of pleasure than other jewelry objects which usually have a generally fixed shape.

Depending upon the relation between the distance between two turns of spring 1 and the width of the aperture 6 created by the grommet which is present on each element 3, it is possible to obtain the mentioned elastic effect when the length of space 6 exceeds the pitch of spring 1, or an unstretchable article when the pitch of the spring is equal or larger than the length of the aperture 6.

It is also important to remark that the method of manufacturing the article according to the invention may foresee the passage of three or more turns of the central spring 1, instead of two, through grommet 5 of an element 3. In order to do this it is sufficient for the length of the aperture 6 to be such as to allow the passage of more than two turns. Naturally, nothing changes as far as the function is concerned of the thus obtained manufactured article.

Figure 4:
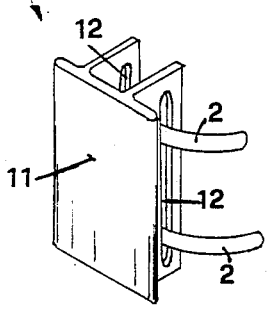
FIG. 4 shows an element differing from the one of the FIGS. 2 and 3, presenting two slots or grommets instead of one grommet.

FIG. 4 shows an element 10 which is also suited to obtain a configuration following the method according to the invention, but differs from the previously described element 3, since here grommet 5 is not present.

Element 10 presents a visible body member 11 and two slots 12 arranged on an opposite surface which slots are parallel to each other and face each other. Through this pair of slots 12 are threaded the two turns 2 of spring 1, so that element 10 works as element 3. Element 10, unlike element 3, can be obtained through the cutting and die-drawing of a flat metal sheet, even of a precious metal, so that welding, which has to be performed in the case of grommet 5 of element 3, is no longer necessary, thus further decreasing the labor necessary.

All the remarks already made concerning the relation between the length of slot 12 and the pitch of the turn 2 of spring 1 apply also to element 10. Thus, if the amplitude of the slots 12 is larger than the pitch of the turns, the manufactured article can be stretched to a point, otherwise it will be unstretchable.

Figure 6:
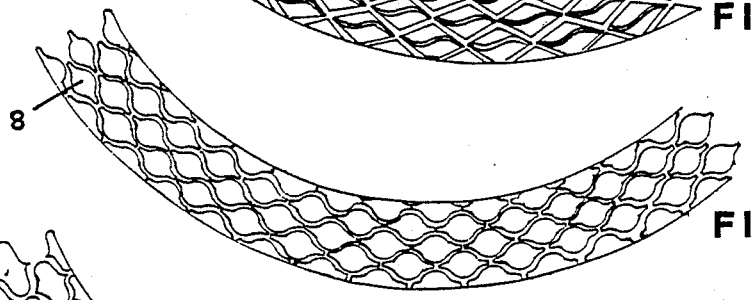
Figure 7:
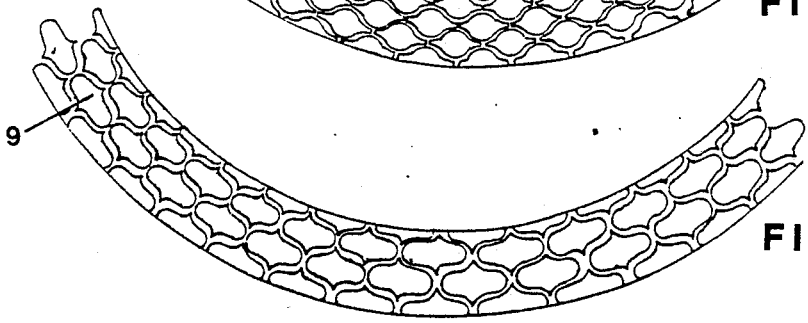

FIGS. 6 and 7 show two examples of articles manufactured following the suggestions given by the invention and presenting two differing aesthetic effectts, since the elements 8 and the elements 9 have an aesthetic shape differing from the shape of the elements 3 of the necklace represented in FIG. 5. However, in these cases, too, both the elements 8 and the elements 9 have a visible body and change surface behind which there is either a grommet or one or more slots allowing the passage of two or more turns of the spring which is the core of the composition of the manufactured article.

It will also be pointed out that the manufactured article according to the invention may also be made with a spring which is not cylindrical or the cross-section of which is not round, but it can have a cross-section of an elliptical type or, at any rate, has a radius so as to allow the formation of a spiral having any type of cross-section, provided that the turns are at the same distance from each other, so that the elements can be orderly placed next to each other, so as to form a regular pattern of the manufactured article. If the manufactured article is made of a precious metal, both spring 1 and the elements 3, 8, 9 or 10 will all be made of gold.

Changes and modifications to the described invention may occur to those skilled in the art, it is, however, understood that they will not exceed the spirit and scope of the patent claims.

I claim:

1. A method of manufacturing generally tube-shaped ornamental articles comprising inserting on a core material provided in the form of a substantially cylindrically shaped helicoidal spring made of a spirally wound metal wire or strap having a predetermined pitch and constant cross-section a plurality of elements each consisting of a body member associated with at least one grommet or slot forming an aperture with said body member, by introducing one free end of said helicoidal spring through said aperture of said at least one grommet or slot and sliding each of said elements toward an opposite end of said spring, until it arranges itself next to a previously inserted element such that at least two turns of said spring pass through said at least one grommet or slot.

2. The method of claim 1, wherein each of said elements comprises two grommets, each having a singular aperture through which said free end of said helicoidal spring is introduced.

3. The method of claim 1, wherein each of said elements comprises two slots, each having a single aperture through which said free end of said helicoidal spring is introduced.

4. The method of claim 1, wherein said aperture has an amplitude at least equal to said pitch of said spring.

5. The method of claim 4, wherein said aperture has an amplitude larger than said pitch of said spring so as to allow for elastic stretching of said manufactured article.

* * * * *